US005122812A

United States Patent [19]

Hess et al.

[11] Patent Number: 5,122,812

[45] Date of Patent: Jun. 16, 1992

[54] THERMAL INKJET PRINTHEAD HAVING DRIVER CIRCUITRY THEREON AND METHOD FOR MAKING THE SAME

[75] Inventors: Ulrich E. Hess, Corvallis, Oreg.; Duane A. Fasen, Loveland, Colo.

[73] Assignee: Hewlett-Packard Company, Palo Alto, Calif.

[21] Appl. No.: 637,387

[22] Filed: Jan. 3, 1991

[51] Int. Cl.[5] ..... B41J 2/05

[52] U.S. Cl. ..... 346/1.1; 346/140 R; 357/51; 437/51; 437/60

[58] Field of Search ..... 346/140, 1.1; 437/60, 437/51; 357/51

[56] References Cited

U.S. PATENT DOCUMENTS

| | | | |
|---|---|---|---|
| 3,852,563 | 12/1974 | Bohorquez et al. . | |
| 4,010,355 | 4/1991 | Hawkins | 346/140 |
| 4,292,730 | 10/1981 | Ports | 357/51 X |
| 4,424,461 | 1/1984 | Taguchi et al. . | |
| 4,429,321 | 1/1984 | Matsumoto | 346/140 |
| 4,500,895 | 2/1985 | Buck et al. | 346/140 |
| 4,510,670 | 4/1985 | Schwabe et al. . | |
| 4,513,298 | 4/1985 | Scheu . | |
| 4,532,530 | 7/1985 | Hawkins | 346/140 |
| 4,596,994 | 6/1986 | Matsuda | 346/140 |
| 4,695,853 | 9/1987 | Hackleman et al. . | |
| 4,719,477 | 1/1988 | Hess | 346/140 |
| 4,794,409 | 12/1988 | Cowger et al. | 346/140 |
| 4,853,718 | 8/1989 | Elhatem et al. . | |
| 4,875,968 | 10/1989 | O'Neill et al. . | |
| 4,899,180 | 2/1990 | Elhatem et al. . | |
| 4,947,192 | 8/1990 | Hawkins et al. | 346/140 |
| 4,948,747 | 8/1990 | Pfiester | 437/60 |
| 4,961,103 | 10/1990 | Saitoh | 357/51 X |

OTHER PUBLICATIONS

*The Hewlett-Packard Journal*, vol. 39, No. 4 (Aug. 1988).

Elliot, D. J., *Integrated Circuit Fabrication Technology*, McGraw-Hill Book Company, New York, NY (1982), pp. 1-41.

Appels, J. A. et al., "Local Oxidation of Silicon; New Technological Aspects", *Philips Research Reports*, vol. 26, No. 3, pp. 157-165 (Jun. 1971).

Kooi, E. et al, "Locos Devices", *Philips Research Reports*, vol. 26, No. 3, pp. 166-180 (Jun. 1971).

*The Hewlett-Packard Journal*, vol. 36, No. 5 (May 1985).

*Primary Examiner*—Joseph W. Hartary

[57] ABSTRACT

An improved thermal inkjet printhead and manufacturing method in which driver circuitry (e.g. MOSFET transistors), heating resistors, and a specialized arrangement of conductive elements are used. A substrate is provided having a plurality of drive transistors thereon. A layer of resistive material (e.g. a tantalum-aluminum mixture) is deposited on the substrate and directly connected to the source, gate, and drain of at least one transistor. A layer of conductive metal (e.g. aluminum) is deposited on a portion of the resistive layer, forming both covered and uncovered regions thereof. The uncovered region functions as a heating resistor, and the covered regions function as direct electrical contacts to the transistor, thereby minimizing the number of conductive elements in the printhead. The resistor is positioned beneath an ink-retaining cavity, and is designed to heat ink therein for expulsion through an orifice plate.

22 Claims, 4 Drawing Sheets

THERMAL INKJET PRINTHEAD HAVING DRIVER CIRCUITRY THEREON AND METHOD FOR MAKING THE SAME

BACKGROUND OF THE INVENTION

The present invention generally relates to thermal inkjet systems, and more particularly to an inkjet printhead having driver circuitry thereon which communicates with the printing resistors and other components of the printhead using a specialized conductive system.

A substantial demand exists for printing systems of high efficiency and resolution. To satisfy this demand, thermal inkjet cartridges have been developed which print in a rapid and efficient manner. These cartridges include an ink reservoir in fluid communication with a substrate having a plurality of resistors thereon. Selective activation of the resistors causes thermal excitation of the ink and expulsion thereof from the cartridge. Representative thermal inkjet systems are discussed in U.S. Pat. No. 4,500,895 to Buck et al., U.S. Pat. No. 4,513,298 to Scheu, U.S. Pat. No. 4,794,409 to Cowger et al., the *Hewlett-Packard Journal,* Vol. 36, No. 5 (May 1985), and the *Hewlett-Packard Journal,* Vol. 39, No. 4 (Aug. 1988).

In recent years, research has been conducted in order to increase the degree of print resolution and quality of thermal inkjet printing systems. Print resolution necessarily depends on the number of printing resistors formed on the cartridge substrate. Modern circuit fabrication techniques allow the placement of substantial quantities of resistors on a single printhead substrate. However, the number of resistors applied to the substrate is limited by the conductive components used to electrically connect the cartridge to external pulse driver circuitry in the printer unit. Specifically, an increasingly large number of resistors requires a correspondingly large number of interconnection pads, leads, and the like. This causes greater manufacturing/production costs, and increases the probability that defects will occur during the manufacturing process.

In order to solve this problem, thermal inkjet printheads have been developed which incorporate pulse driver circuitry (e.g. metal oxide semiconductor field effect (MOSFET) transistors) directly on the printhead substrate with the resistors. This development is described in U.S. Pat. No. 4,719,477 to Hess. The incorporation of driver circuitry on the printhead substrate in this manner reduces the number of interconnect components need to electrically connect the cartridge to the printer unit. This results in an improved degree of production and operating efficiency.

The integration of driver components and printing resistors onto a common substrate also results in a need for specialized, multi-layer connective circuitry so that the driver transistors can communicate with the resistors and other portions of the printing system. Typically, this connective circuitry involves a plurality of separate conductive layers, each being formed using conventional circuit fabrication techniques. However, this procedure again results in increased production costs and diminished manufacturing efficiency. The present invention involves a unique conductive system for electrically connecting the driver transistors with the transistors) integrally formed thereon. Each resistor is produced by the application of a layer of resistive material onto the substrate. The layer of resistive material preferably consists of a composition selected from the group consisting of polycrystalline silicon, a co-sputtered mixture of tantalum and aluminum, and tantalum nitride. The layer of resistive material is applied so that it is in direct physical engagement with the electrical contact regions of the drive transistors (e.g., the source, gate, and drain of MOSFET transistors). A layer of conductive material (e.g., aluminum, gold, or copper) is positioned on selected portions of the layer of resistive material in order to form covered sections of the resistive material and uncovered sections thereof. The uncovered sections ultimately function as heating resistors in the printhead. The covered sections are used to form continuous conductive links between the electrical contact regions of the transistors and other components in the printing system (e.g. the heating resistors). Thus, the layer of resistive material performs dual functions: (1) as heating resistors in the system, and (2) as direct conductive pathways to the drive transistors. This is a significant development, and substantially eliminates the need to use multiple layers for carrying out these functions.

A selected portion of protective material is then applied to the covered and uncovered sections of resistive material. Thereafter, an orifice plate member having a plurality of openings therethrough is positioned on the protective material. Beneath the opening, a section of the protective material is removed in order to from an ink-receiving cavity thereunder. Positioned below each cavity is one of the heating resistors formed as described above. The activation of each resistor by its associated driver transistor causes the resistor to printing resistors and other necessary components. The invention uses a minimal number of conductive layers which are arranged in a special manner in order to reduce the number of production steps. The resulting product operates in a highly efficient manner, and is economically manufactured compared with previous production methods.

SUMMARY OF THE INVENTION

It is an object of the present invention to provide a thermal inkjet printing system of improved design.

It is another object of the invention to provide a thermal inkjet printing system which is readily manufactured using a minimal number of processing steps.

It is another object of the invention to provide a thermal inkjet printing system which uses a minimal number of operating components.

It is a further object of the invention to provide a thermal inkjet printing system in which the amount and complexity of interconnect components used to connect the ink cartridge to the printer is reduced.

It is a still further object of the invention to provide a thermal inkjet printing system which uses a substrate having driver circuitry and heating resistors integrally formed thereon.

It is an even further object of the invention to provide a thermal inkjet printing system which uses a specialized conductive system for electrically connecting the driver circuitry and heating resistors of the printhead, both of which are formed on a common substrate.

In accordance with the foregoing objects, the present invention involves a specialized inkjet printhead which operates efficiently and is readily manufactured using a minimal number of processing steps. Specifically, the printhead consists of a substrate which includes heating resistors and pulse drive circuitry (e.g. MOSFET heat the cavity above it, thereby expelling ink therefrom.

These and other objects, features, and advantages of the present invention shall be described below in the following Brief Description of the Drawings and Detailed Description of Preferred Embodiments.

BRIEF DESCRIPTION OF THE DRAWINGS

Illustrative and presently preferred embodiments of the invention are shown in the accompanying drawings in which.

DETAILED DESCRIPTION OF A PREFERRED EMBODIMENT

Figure 2:
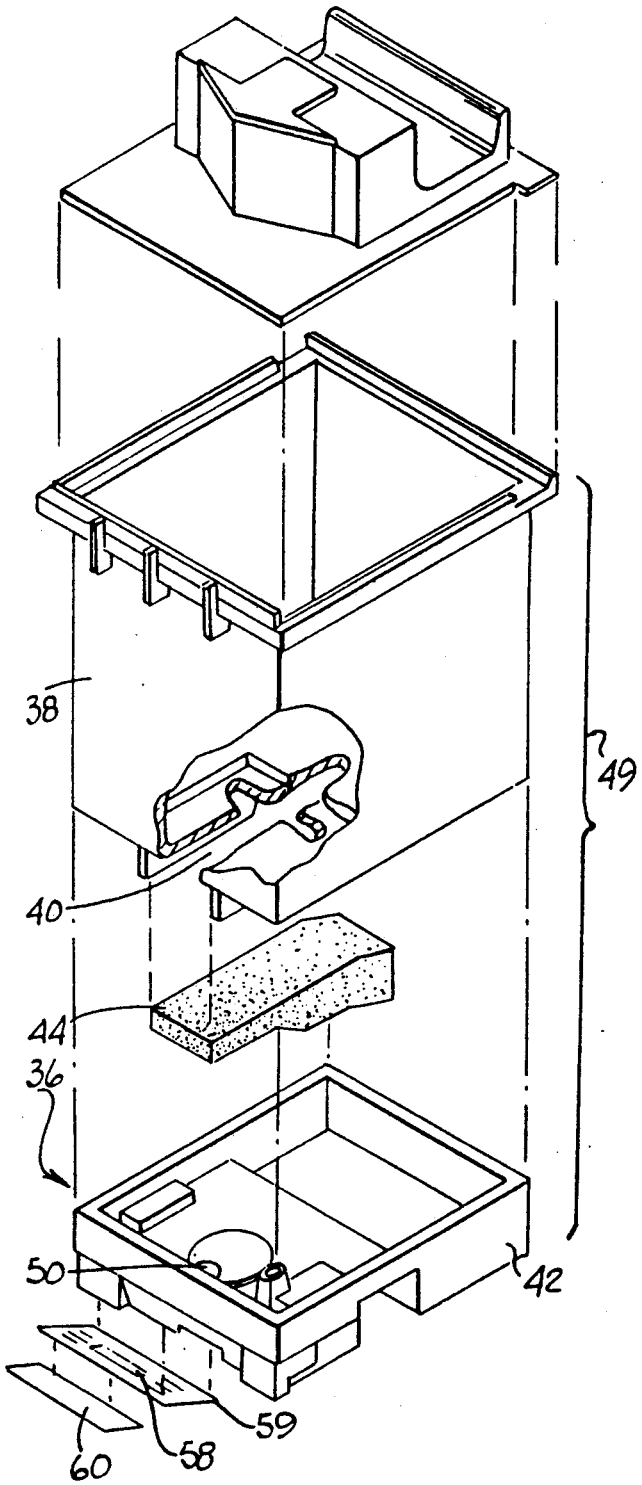
FIG. 2 is a partially exploded perspective view of an alternative thermal inkjet cartridge in which the present invention may be used.
Figure 1:
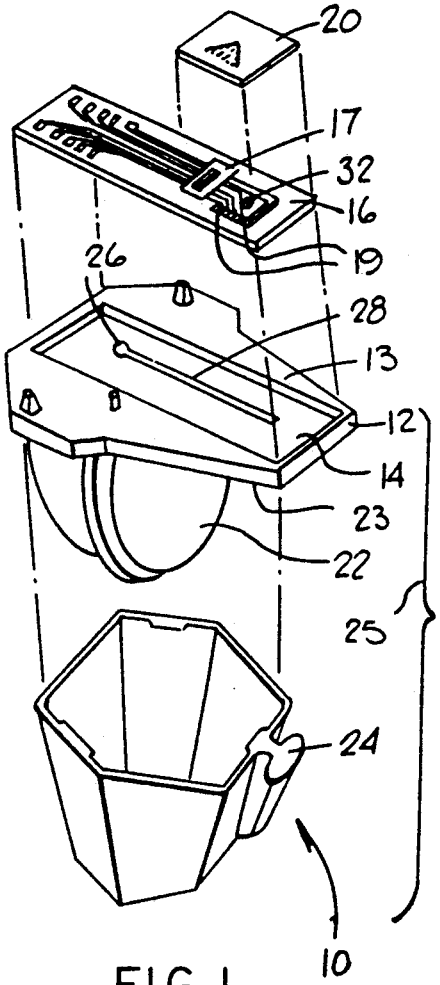
FIG. 1 is a partially exploded perspective view of a representative thermal inkjet cartridge in which the present invention may be used.

The present invention involves a specialized thermal inkjet printhead having driver circuitry and heating resistors thereon. Both of these components are electrically connected to each other in a unique manner as described herein. With reference to FIGS. 1 and 2, exemplary thermal ink jet cartridges are illustrated which are suitable for use with the present invention. However, the invention is prospectively applicable to other thermal inkjet printing systems, and shall not be limited to incorporation within the cartridges of FIGS. 1 and 2.

With continued reference to FIG. 1, a cartridge 10 is shown which includes a backing plate 12 having an outer face 13 with a recess 14 therein. Secured within the recess 14 is a substrate 16. The substrate 16 may be configured as desired to include both pulse driver circuitry 17 and heating resistors 19 thereon as schematically illustrated in FIG. 1 and discussed in U.S. Pat. No. 4,719,477 to Hess. Positioned on the substrate 16 is an orifice plate 20 through which ink is ultimately ejected. The cartridge 10 further includes ink-retaining means in the form of a flexible bladder unit 22 which is fixedly secured to the inner face 23 of the backing plate 12. The bladder unit 22 is positioned within a protective cover member 24 which is secured to the backing plate 12. Accordingly, the backing plate 12 and the cover member 24 combine to form a housing 25 designed to retain the bladder unit 22 therein. An outlet 26 is provided through the backing plate 12 which communicates with the interior of the bladder unit 22. In operation, ink flows from the bladder unit 22 through outlet 26. Thereafter, the ink flows through channel 28 and passes into an opening 32 through the substrate 16 where it is subsequently dispensed. Further structural details regarding cartridge 10, as well as the operational characteristics thereof are described in U.S. Pat. No. 4,500,895 to Buck et al. which, along with U.S. Pat. No. 4,719,477, is incorporated herein by reference. Cartridge 10 is currently being manufactured and sold by the Hewlett-Packard Company of Palo Alto, Calif. under the THINKJET trademark.

In FIG. 2, an additional exemplary cartridge 36 with which the present invention may be used is illustrated. Cartridge 36 includes a reservoir 38 having an opening 40 in the bottom thereof as illustrated. Also included is a lower portion 42 sized to receive ink-retaining means in the form of a porous, sponge-like member 44. The reservoir 38 and the lower portion 42 attach together to form a housing 49 in which the sponge-like member 44 is positioned. Ink from the reservoir 38 flows through opening 40 into the porous sponge-like member 44. Thereafter, during printer operation, ink flows from the sponge-like member 44 through an outlet 50 in the lower portion 42. The ink then passes through an additional opening 58 in a substrate 59 which may include driver circuitry and heating resistors (not shown) thereon in accordance with U.S. Pat. No. 4,719,477. The cartridge 36 further includes an orifice plate 60 through which the ink passes during printer operation. Additional details and operational characteristics of cartridge 36 are discussed in U.S. Pat. No. 4,794,409 to Cowger, et al. which is incorporated herein by reference. Cartridge 36 is currently being manufactured and sold by the Hewlett-Packard Company of Palo Alto, Calif. under the DESKJET trademark. Furthermore, the general construction and operation of thermal inkjet systems is described in the *Hewlett-Packard Journal*, Vol. 36, No. 5 (May 1985) and the *Hewlett-Packard Journal*, Vol. 39, No. 4 (Aug. 1988), both of which are also incorporated herein by reference.

As previously indicated, enhanced print resolution is an important goal in the design of thermal inkjet printing systems. Normally, this goal is accomplished through the use of increased numbers of heating resistors. Modern circuit fabrication techniques enable substantial amounts of resistors to be fabricated on printer substrates. However, physical limitations exist with respect to the conductive connection circuitry used to connect the resistors to pulse driver circuitry in the printer unit as noted above. To solve this problem, thermal inkjet printheads have been developed which include pulse driver components (e.g. MOSFET transistors) directly on the substrate, as described in U.S. Pat. No. 4,719,477. This development substantially reduces the number of connective components necessary for cartridge operation. Nonetheless, the integration of both heating resistors and MOSFET driver transistors onto a common substrate created a need for additional layers of conductive circuitry on the substrate so that the transistors may be electrically connected to the resistors and other components of the system. These additional layers result in increased production and material costs. The present invention involves a special circuit arrangement for connecting the resistors, transistors, and other components of the system together which avoids these problems in a highly efficient manner.

With reference to FIGS. 3–11, schematic illustrations are provided which show the process steps necessary to electrically connect the electrical contact regions of the pulse drive transistors with the heating resistors and other printer components in accordance with the present invention. The term "electrical contact regions" as used herein shall represent the source, gate, and drain of a MOSFET transistor or the base, collector, and emitter of a bi-polar transistor device.

Figure 3:
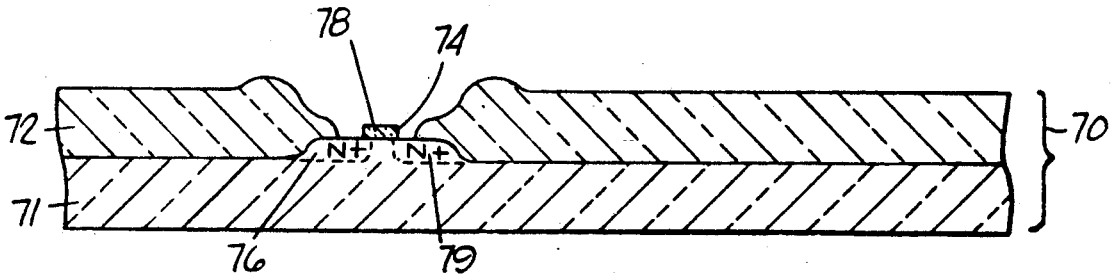
FIGS. 3–11 involve enlarged, cross-sectional schematic views of the materials and sequential production steps used to produce a thermal inkjet printhead in accordance with the present invention, with the completed product being schematically illustrated in FIG. 11.

FIG. 3 illustrates a substrate 70 which, in a preferred embodiment, has a lower portion 71 manufactured of P-type monocrystalline silicon. The lower portion 71 preferably has a thickness of about 19–21 mils (20 mils =optimum).

The substrate 70 further includes an upper layer 72 of silicon dioxide which is formed by thermal oxidation. Alternatively, upper layer 72 may be formed by heating the lower portion 71 in a mixture of silane, oxygen, and argon at a temperature of about 300–400 degrees C. until the desired thickness of silicon dioxide has been formed, as discussed in U.S. Pat. 4,513,298 to Scheu which is incorporated herein by reference. Thermal oxidation processes, and other basic layer formation techniques described herein, including chemical vapor deposition (CVD), plasma-enhanced chemical vapor deposition (PECVD), low-pressure chemical vapor deposition (LPCVD), and masking/imaging processes used for layer definition are well known in the art and described in a book by Elliott, D. J., entitled *Integration Circuit Fabrication Technology,* McGraw-Hill Book Company, New York, 1982 (ISBN No. 0-07-019238-3).

The upper layer 72 has a preferred thickness of about 10,000–24,000 angstroms (17,000 angstroms=optimum). For the purposes of this application, the substrate 70 shall be defined to include both the lower portion 71 and the upper layer 72. In a preferred embodiment, the upper layer 72 may also include a thin dielectric substrate layer (not shown). An exemplary material for this purpose includes CVD deposited silicon dioxide at a thickness of about 3500–4500 angstroms (4000 angstroms=optimum). In an alternative embodiment, silicon nitride may be used at a thickness of about 800–1200 angstroms. Again, the substrate 70 shall be defined herein to include the dielectric layer described above.

Integrally formed on the substrate 70 is a plurality of drive transistors (e.g. of the MOSFET type), one of which is schematically illustrated at reference number 74 in FIG. 3. Basically, the transistor 74 is of the MOSFET silicon-gate variety, and includes a source diffusion 76, gate 78 and drain diffusion 79, all of which define electrical contact regions to which various components (e.g. resistors) and electrical circuitry may be connected using the present invention as described in greater detail below. Formation techniques involving MOSFET transistors are well known in the art, and date back to the early 1960's. MOSFET transistor formation is specifically discussed in Appels, J. A. et al., "Local Oxidation of Silicon; New Technological Aspects," *Philips Research Reports,* Vol. 26, No. 3, pp. 157–165 (Jun. 1971); Kooi, E., et al., "Locos Devices," *Philips Research Reports,* Vol. 26, No. 3, pp. 166–180 (Jun. 1971); U.S. Pat. No. 4,510,670 to Schwabe; and Elliot, D. J., supra. all of which are incorporated herein by reference.

Figure 4:
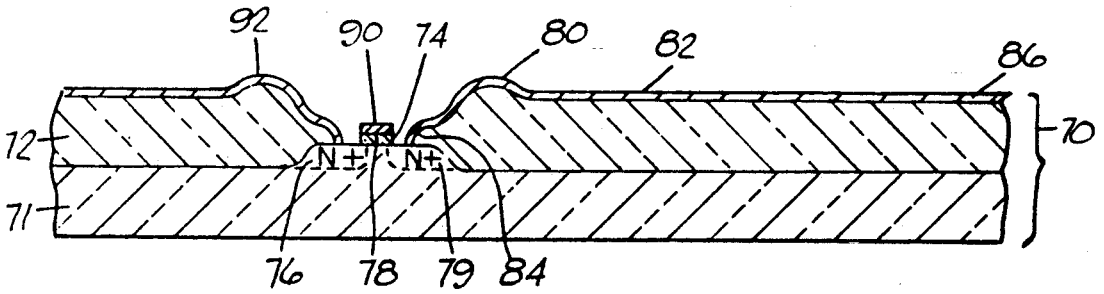

Next, a layer 80 of electrically resistive material is applied directly on top of the upper layer 72 of the substrate 70 (FIG. 4). As shown in FIG. 4, the layer 80 includes a first section 82 having a first end 84 and a second end 86. The first section 82 is continuous and uninterrupted from end 84 to end 86. In addition, end 84 is in direct physical contact with drain diffusion 79 of transistor 74 as illustrated, with no intervening layers of material therebetween. This direct connection is an important and substantial departure from previously-designed systems.

The layer 80 also consists of a second section 90 which is positioned in direct electrical/physical contact with gate 78 of the transistor 74, and is electrically separated from the first section 82 of the layer 80. Furthermore, the layer 80 shown in FIG. 4 includes a third section 92 which electrically communicates with the source diffusion 76 of the transistor 74. The ultimate functions of the first section 82, second section 90 and third section 92 will be described hereinafter.

In one embodiment, the resistive material used to form layer 80 is manufactured of a mixture of aluminum and tantalum. Likewise, tantalum nitride may be used, although the tantalum-aluminum mixture is preferred. This mixture is known in the art as a resistive material, and is formed by the co-sputtering of both materials (as opposed to alloying of the materials, which involves a different process). Specifically, the final mixture basically consists of about 60–40 atomic (at.) % tantalum (50 at. %=optimum) and about 40–60 at. % aluminum (50 at. %=optimum). It is especially effective as an ohmic and metallurgically compatible contact material relative to the silicon compositions in the transistor 74.

In an alternative embodiment, the layer 80 may consist of phosphorous-doped polycrystalline silicon. This material is described in U.S. Pat. No. 4,513,298 to Scheu. The formation thereof is accomplished using oxide masking and diffusion techniques well known in the art and discussed in Elliott, David J., supra. In addition to functioning as an effective resistor material, the polycrystalline silicon has a rough, yet uniform surface. This type of surface (which is readily repeatable during the manufacturing process) is ideal for the promotion of ink bubble nucleation thereon (bubble formation). In addition, polycrystalline silicon is highly stable at elevated temperatures, and avoids the oxidation problems characteristic of other resistive materials. The polycrystalline silicon is preferably applied by the LPCVD deposition of silicon resulting from the decomposition of a selected silicon composition (e.g. silane) diluted by argon as discussed in U.S. Pat. No. 4,513,298. A typical temperature range for achieving this decomposition is about 600–650 degrees C., and a typical deposition rate is about one micron per minute. Doping is accomplished using oxide masking and diffusion techniques well known in the art of semiconductor doping and discussed in U.S. Pat. No. 4,513,298 to Scheu and in Elliott, D. J., supra.

In general, the layer 80 (if manufactured of, e.g., tantalum-aluminum) is applied at a uniform thickness of about 770–890 angstroms (830 angstroms=optimum). If polycrystalline silicon is used, the layer 80 is applied at a thickness of about 3000–5000 angstroms (4000 angstroms=optimum).

Figure 5:
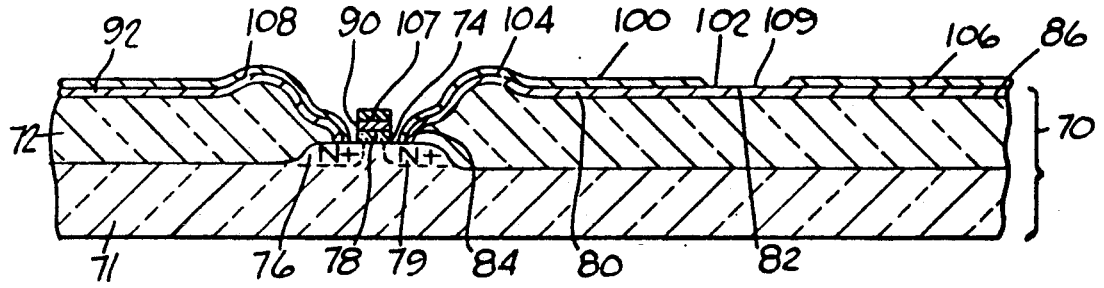

With reference to FIG. 5, a conductive layer 100 is then applied directly on selected portions of the layer 80 of resistive material. In a preferred embodiment, the conductive layer may consist of aluminum, copper, or gold, with aluminum being preferred. In addition, the metals used to form the conductive layer 100 may be optionally doped or combined with other materials, including copper and/or silicon. If aluminum is used, the copper is designed to control problems associated with electro-migration, while the silicon is designed to prevent side reactions between the aluminum and other silicon-containing layers in the system. An exemplary and preferred material used to produce the conductive layer 100 consists of about 95.5% by weight aluminum, about 3.0% by weight copper, and about 1.5% by weight silicon, although the present invention shall not be limited to the use of this specific composition. In general, the conductive layer 100 will have a uniform thickness of about 4000–6000 angstroms (5000 angstroms =optimum), and is applied using conventional sputtering or vapor deposition techniques.

As shown in FIG. 5, the conductive layer 100 does not completely cover all portions of the layer 80 of resistive material. Specifically, only part of the first section 82 is covered. The second section 90 and the third section 92 are entirely covered as described below. With continued reference to FIG. 5, the layer 80 is basically divided into an uncovered section 102 and covered sections 104, 106, 107, and 108. The uncovered section 102 functions as a heating resistor 109 which ultimately causes ink bubble nucleation during cartridge operation. The covered section 104 serves as a direct conductive bridge between the resistor 109 and the drain diffusion 79 of the transistor 74, and enables these components to electrically communicate with each other. Furthermore, this specific arrangement of layers provides a unique and substantial increase in production efficiency and economy.

From a technical standpoint, the presence of conductive layer 100 over the layer 80 of resistive material defeats the ability of the resistive material (when covered) to generate significant amounts of heat. Specifically, the electrical current, flowing via the path of least resistance, will be confined to the conductive layer 100, thereby generating minimal thermal energy. Thus, the layer 80 only functions as a resistor at the uncovered section 102. The function of the covered sections 106, 107, and 108 will again be described hereinafter.

Figure 6:
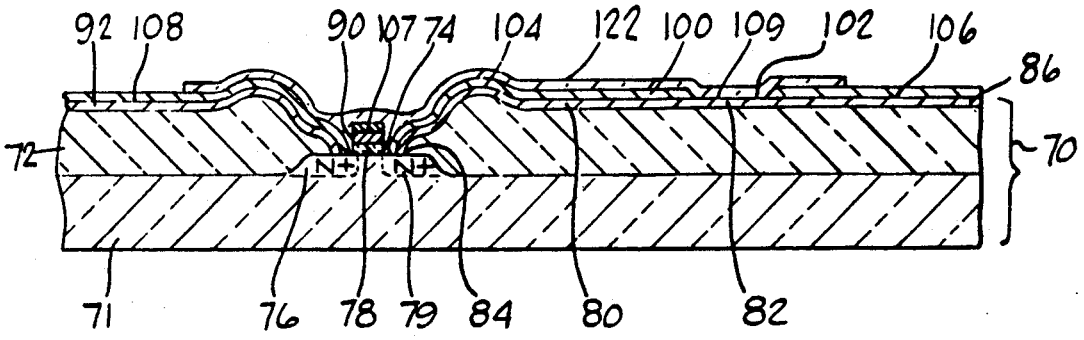
Figure 9:
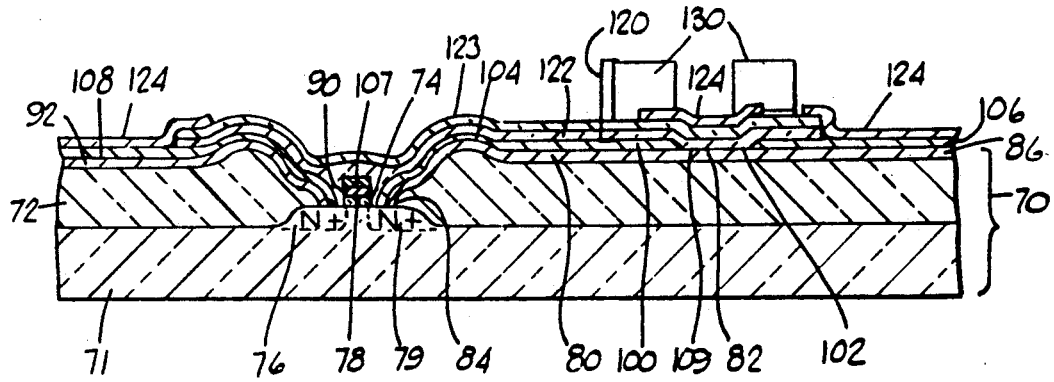

Next, as shown in FIG. 9, a portion 120 of protective material is positioned on top of the underlying conductive material layers, as described in greater detail below. The portion 120 of protective material actually includes four main layers in the present embodiment. Specifically, as shown in FIG. 6, a first passivation layer 122 is provided which preferably consists of silicon nitride. Layer 122 is applied by the PECVD of silicon nitride resulting from the decomposition of silane mixed with ammonia at a pressure of about 2 torr and temperature of about 300–400 degrees C. The layer 122 covers the resistor 109 and the transistor 74 as illustrated. The main function of the passivation layer 122 is to protect the resistor 109 (and the other components listed above) from the corrosive action of the ink used in the cartridge. This is especially important with respect to resistor 109, since any physical damage thereto can dramatically impair its basic operational capabilities. The passivation layer 122 preferably has a thickness of about 4000–6000 angstroms (5000 angstroms =optimum).

Figure 7:
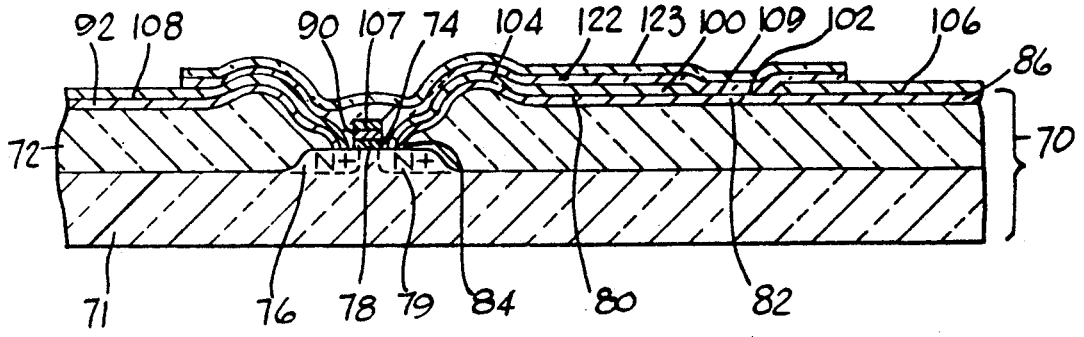

The portion 120 of protective material also includes a second passivation layer 123 which is preferably manufactured of silicon carbide (FIG. 7). In a preferred embodiment, the layer 123 is formed by PECVD using silane and methane at a temperature of about 300–450 degrees C. The layer 123 covers the layer 122 as illustrated, and is again designed to protect the resistor 109 and other components listed above from corrosion damage.

Figure 8:
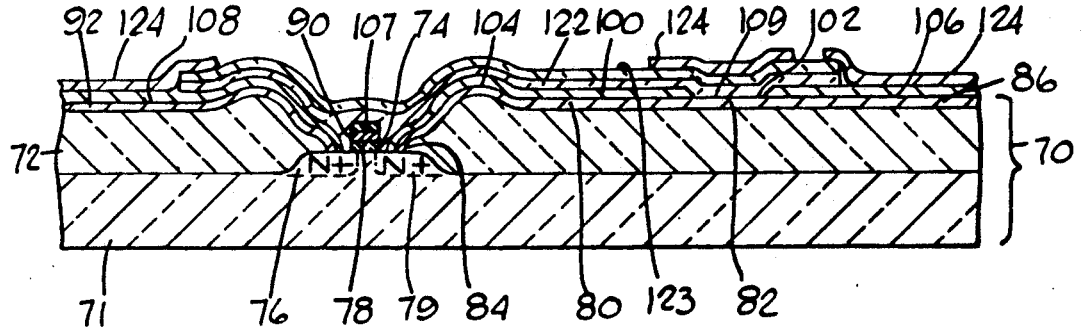

With reference to FIG. 8, portion 120 of protective material further includes a conductive cavitation layer 124 which is selectively applied to various areas of the circuit as illustrated. However, the principal use of the cavitation layer 124 is over the portion of the second passivation layer 123 which covers the resistor 109. The purpose of the cavitation layer 124 is to eliminate or minimize mechanical damage to the resistor 109 and dielectric passivation films. In a preferred embodiment, the cavitation layer 124 consists of tantalum, although tungsten or molybdenum may also be used. The cavitation layer 124 is preferably applied by conventional sputtering techniques, and is normally about 5500–6500 angstroms thick (6000 angstroms=optimum).

Finally, as shown in FIG. 9, the portion 120 of protective material includes an ink barrier layer 130 selectively applied to and above the cavitation layer 124 and portions of the second passivation layer 123 on both sides of the resistor 109 as illustrated. The barrier layer 130 is preferably made of an organic polymer plastic which is substantially inert to the corrosive action of ink. Exemplary plastic polymers suitable for this purpose include products sold under the names VACREL and RISTON by E. I. DuPont de Nemours and Co. of Wilmington, Del. These products actually consist of polymethylmethacrylate, and are applied to the cavitation layer 124 by conventional lamination techniques. In a preferred embodiment, the barrier layer 130 has a thickness of about 200,000–300,000 angstroms (254,000 angstroms=optimum). It is designed to control refilling and collapse of the ink bubble during bubble nucleation, and also minimizes cross-talk between adjacent resistors in the system. Furthermore, the materials listed above can withstand temperatures as high as 300 degrees C., and have good adhesive properties for holding the orifice plate of the printhead in position, as described below.

Figure 10:
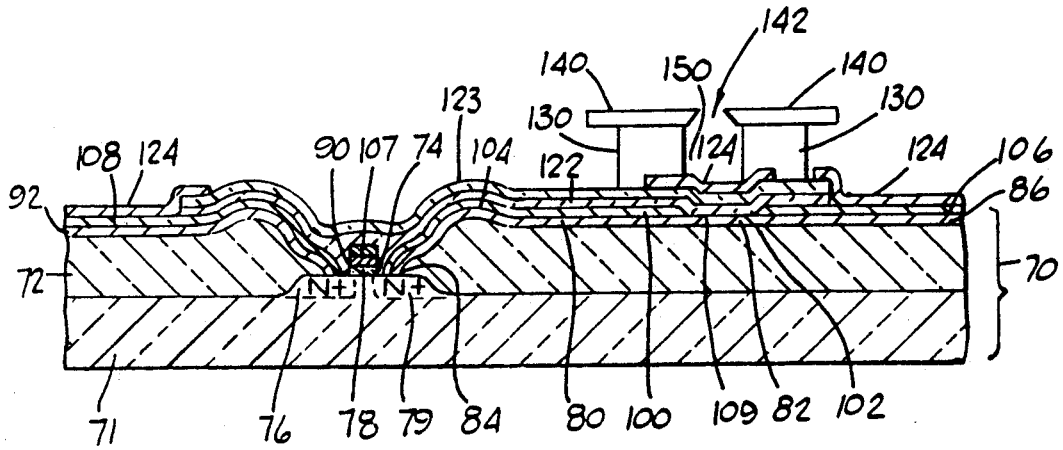

Finally, an orifice plate 140 known in the art is applied to the surface of the barrier layer 130 as shown in FIG. 10. The orifice plate 140 controls both drop volume and direction, and is preferably manufactured of nickel. It also includes a plurality of openings therein, each opening corresponding to at least one of the resistors in the system. The orifice plate 140 schematically illustrated in FIG. 10 includes an opening 142 which is directly above and aligned with the resistor 109. In addition, a section of the barrier layer 130 directly above the resistor is removed or selectively applied in a conventional manner during the manufacturing process in order to form an opening or cavity 150 which is designed to receive ink from a source within the cartridge (e.g. a storage bladder unit or sponge-like member as previous described). Accordingly, activation of the resistor 109 imparts heat to the ink within the cavity 150 through layers 122, 123, 124, resulting in bubble nucleation.

Figure 11:
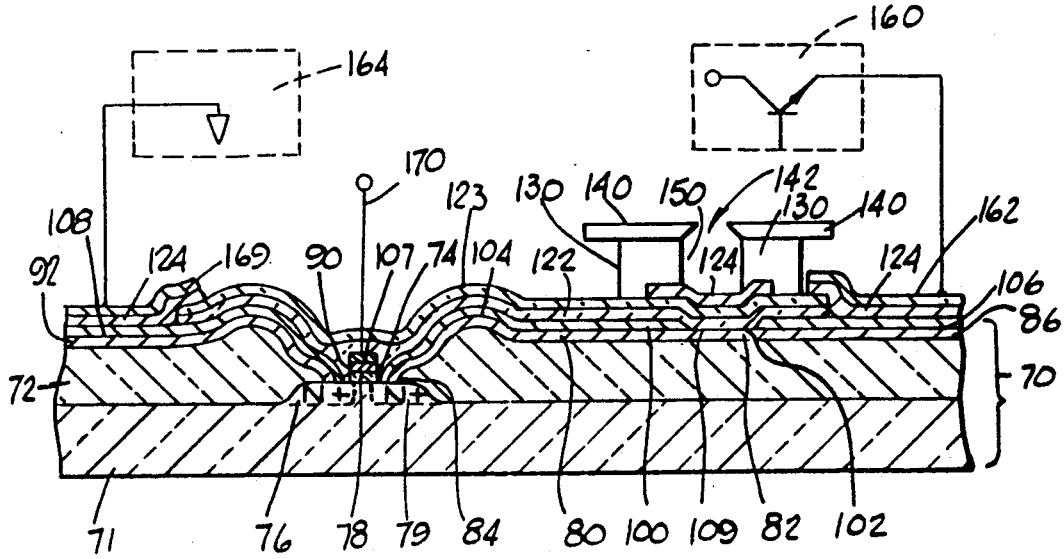

The resistor 109 also electrically communicates with a conventional source 160 of drain voltage which is located externally in the printer unit (not shown) and schematically illustrated in FIG. 11. Communication is accomplished via covered section 106 of layer 80 which is in direct physical contact with the conductive cavitation layer 124. Cavitation layer 124 communicates with an external contact layer 162 of conductive metal (e.g. gold) applied by sputtering at a thickness of about 4000–6000 angstroms (5000 angstroms=optimum). An identical configuration exists with respect to connection of the source diffusion 76 of the transistor 74 to an external ground 164. Connection is accomplished via the covered section 108 of layer 80. The covered section 108 electrically communicates with the ground 164 through cavitation layer 124 and an external contact layer 169 of the same type described above relative to layer 162. Finally, an external lead 170 is connected to gate 78 of the transistor 74 directly through passivation layers 122, 123 as illustrated. Lead 170 is specifically connected to the covered section 107 of the layer 80.

The present invention as described herein represents an advance in thermal inkjet printhead design and fabrication. Use of the layer of resistive material for both resistor construction and transistor interconnection purposes offers numerous and substantial benefits compared with other, more complex systems. Having herein described a preferred embodiment of the present invention, it is anticipated that suitable modifications may be made thereto by individuals skilled in the art within the scope of the invention. For example, the exact configuration, size, and quantity of materials used to produce the circuit structure of the present invention may be suitably varied. Likewise, the basic circuit fabrication techniques referenced herein may also be varied as desired. Thus, the invention shall only be construed in accordance with the following claims:

We claim:

1. A thermal inkjet printhead structure comprising:
a substrate;
at least one drive transistor formed on said substrate, said drive transistor comprising a plurality of electrical contact regions thereon;
a layer of electrically resistive material affixed to said substrate, said layer of electrically resistive material being in direct physical contact with said electrical contact regions of said drive transistor, said layer of electrically resistive material comprising at least one metal therein;
a layer of conductive material directly affixed to a portion of said layer of electrically resistive material, said layer of electrically resistive material having at least one uncovered section wherein said layer of conductive material is absent therefrom, said uncovered section functioning as a heating resistor, said layer of electrically resistive material being covered with said layer of conductive material at said electrical contact regions of said drive transistor, said layer of conductive material comprising at least one metal therein;
a portion of protective material positioned on said heating resistor; and
a plate member having at least one opening therethrough, said plate member being secured to said portion of protective material, said portion of protective material having a section thereof removed directly beneath said opening through said plate member in order to form an ink receiving cavity thereunder, said heating resistor being positioned beneath and in alignment with said ink receiving cavity in order to impart heat thereto.

2. The printhead structure of claim 1 wherein said drive transistor is a metal oxide semiconductor field effect transistor.

3. The printhead structure of claim I wherein said layer of electrically resistive material is comprised of a mixture of tantalum and aluminum.

4. The printhead structure of claim 1 wherein said layer of conductive material is comprised of a metal selected from the group consisting of aluminum, copper, and gold.

5. The printhead structure of claim 1 wherein said portion of protective material comprises:
a first passivation layer positioned on said resistor, said first passivation layer being comprised of silicon nitride;
a second passivation layer positioned on said first passivation layer, said second passivation layer being comprised of silicon carbide;
a cavitation layer positioned on said second passivation layer, said cavitation layer being comprised of a metal selected from the group consisting of tantalum, tungsten, and molybdenum; and
an ink barrier layer positioned on said cavitation layer, said ink barrier layer being comprised of plastic, said plate member being secured to said ink barrier layer.

6. A thermal inkjet printhead structure comprising:
a substrate;
at least one drive transistor formed on said substrate, said drive transistor comprising a plurality of electrical contact regions thereon;
a layer of electrically resistive material affixed to said substrate, said layer of electrically resistive material being in direct physical contact with said electrical contact regions of said drive transistor, said layer of electrically resistive material being comprised of a mixture of aluminum and tantalum;
a layer of conductive material comprised of a metal selected from the group consisting of aluminum, copper, and gold directly affixed to a portion of said layer of electrically resistive material, said layer of electrically resistive material having at least one uncovered section wherein said layer of conductive material is absent therefrom, said uncovered section functioning as a heating resistor, said layer of electrically resistive material being covered with said layer of conductive material at said electrical contact regions of said drive transistor;
a first passivation layer positioned on said resistor, said first passivation layer being comprised of silicon nitride;
a second passivation layer positioned on said first passivation layer, said second passivation layer being comprised of silicon carbide;
a cavitation layer positioned on said second passivation layer, said cavitation layer being comprised of a metal selected from the group consisting of tantalum, tungsten, and molybdenum;
an ink barrier layer positioned on said cavitation layer, said ink barrier layer being comprised of plastic; and
a plate member having at least one opening therethrough, said plate member being secured to said ink barrier layer, said ink barrier layer having a section thereof removed directly beneath said opening through said plate member in order to form an ink receiving cavity thereunder, said heating resistor being positioned beneath and in alignment with said ink receiving cavity in order to impart heat thereto.

7. A thermal inkjet printing apparatus comprising:
a housing having at least one outlet therethrough;
storage means within said housing for retaining a supply of liquid ink therein; and
a printhead secured to said housing, said printhead being in fluid communication with said storage means through said outlet and comprising:
a substrate;
at least one drive transistor formed on said substrate, said drive transistor comprising a plurality of electrical contact regions thereon;
a layer of electrically resistive material affixed to said substrate, said layer of electrically resistive material being in direct physical contact with said electrical contact regions of said drive transistor, said layer of electrically resistive material comprising at least one metal therein;

a layer of conductive material directly affixed to a portion of said layer of electrically resistive material, said layer of electrically resistive material having at least one uncovered section wherein said layer of conductive material is absent therefrom, said uncovered section functioning as a heating resistor, said layer of electrically resistive material being covered with said layer of conductive material at said electrical contact regions of said drive transistor, said layer of conductive material comprising at least one metal therein;

a portion of protective material positioned on said heating resistor; and a plate member having at least one opening therethrough, said plate member being secured to said portion of protective material, said portion of protective material having a section thereof removed directly beneath said opening through said plate member in order to form an ink receiving cavity thereunder, said heating resistor being positioned beneath and in alignment with said ink receiving cavity in order to impart heat thereto.

8. The apparatus of claim 7 wherein said drive transistor of said printhead is a metal oxide semiconductor field effect transistor.

9. The apparatus of claim 7 wherein said layer of electrically resistive material of said printhead is comprised of a mixture of tantalum and aluminum.

10. The apparatus of claim 7 wherein said layer of conductive material of said printhead is comprised of a metal selected from the group consisting of aluminum, copper, and gold.

11. The apparatus of claim 7 wherein said portion of protective material of said printhead comprises:

a first passivation layer positioned on said resistor, said first passivation layer being comprised of silicon nitride;

a second passivation layer positioned on said first passivation layer, said second passivation layer being comprised of silicon carbide;

a cavitation layer positioned on said second passivation layer, said cavitation layer being comprised of a metal selected from the group consisting of tantalum, tungsten, and molybdenum; and an ink barrier layer positioned on said cavitation layer, said ink barrier layer being comprised of plastic, said plate member being secured to said ink barrier layer.

12. A thermal inkjet printing apparatus comprising:

a housing having at least one outlet therethrough;

storage means within said housing for retaining a supply of liquid ink therein; and a printhead secured to said housing, said printhead being in fluid communication with said storage means through said outlet and comprising:

a substrate;

at least one drive transistor formed on said substrate, said drive transistor comprising a plurality of electrical contact regions thereon;

a layer of electrically resistive material affixed to said substrate, said layer of electrically resistive material being in direct physical contact with said electrical contact regions of said drive transistor, said layer of electrically resistive material being comprised of a mixture of tantalum and aluminum;

a layer of conductive material comprised of a metal selected from the group consisting of aluminum, copper and gold directly affixed to a portion of said layer of electrically resistive material, said layer of electrically resistive material having at least one uncovered section wherein said layer of conductive material is absent therefrom, said uncovered section functioning as a heating resistor, said layer of electrically resistive material being covered with said layer of conductive material at said electrical contact regions of said drive transistor;

a first passivation layer positioned on said resistor, said first passivation layer being comprised of silicon nitride;

a second passivation layer positioned on said first passivation layer, said second passivation layer being comprised of silicon carbide;

a cavitation layer positioned on said second passivation layer, said cavitation layer being comprised of a metal selected from the group consisting of tantalum, tungsten, and molybdenum;

an ink barrier layer positioned on said cavitation layer, said ink barrier layer being comprised of plastic; and a plate member having at least one opening therethrough, said plate member being secured to said ink barrier layer, said ink barrier layer having a section thereof removed directly beneath said opening through said plate member in order to form an ink receiving cavity thereunder, said heating resistor being positioned beneath and in alignment with said ink receiving cavity in order to impart heat thereto.

13. A method for manufacturing a thermal inkjet printhead structure comprising the steps of:

providing a substrate having at least one drive transistor thereon, said drive transistor comprising a plurality of electrical contact regions thereon;

applying a layer of electrically resistive material onto said substrate and onto said electrical contact regions of said transistor, said layer of electrically resistive material comprising at least one metal therein;

applying a layer of conductive material directly onto said layer of electrically resistive material, said layer of electrically resistive material having at least one uncovered section wherein said layer of conductive material is absent therefrom, said layer of conductive material covering said layer of electrically resistive material on said electrical contact regions of said transistor, said uncovered section functioning as a heating resistor, said layer of conductive material comprising at least one metal therein;

applying a portion of protective material onto said resistor; and securing a plate member having at least one opening therethrough onto aid portion of protective material, said portion of protective material having a section thereof removed directly beneath said opening through said plate member in order to form an ink receiving cavity thereunder, said heating resistor being positioned beneath and in alignment with said ink receiving cavity in order to impart heat thereto.

14. The method of claim 13 wherein said layer of electrically resistive material is comprised of a mixture of tantalum and aluminum.

15. The method of claim 13 wherein said layer of conductive material is comprised of a metal selected from the group consisting of aluminum, copper, and gold.

16. The method of claim 13 wherein said applying of said portion of protective material comprises the steps of:

applying a passivation layer comprised of silicon nitride onto said resistor;

applying a second passivation layer comprised of silicon carbide onto said first passivation layer;

applying a cavitation layer comprised of a metal selected from the group consisting of tantalum, tungsten, and molybdenum onto said second passivation layer; and applying an ink barrier layer comprised of plastic onto said cavitation layer, said plate member being secured to said ink barrier layer.

17. A method for manufacturing a thermal inkjet printhead structure comprising the steps of:

providing a substrate having at least one drive transistor thereon, said drive transistor comprising a plurality of electrical contact regions thereon;

applying a layer of electrically resistive material onto said substrate and onto said electrical contact regions of said transistor, said layer of electrically resistive material being comprised of a mixture of tantalum and aluminum;

applying a layer of conductive material comprised of a metal selected from the group consisting of aluminum, copper, and gold directly onto said layer of electrically resistive material, said layer of electrically resistive material having at least one uncovered section wherein said layer of conductive material is absent therefrom, said layer of conductive material covering said layer of electrically resistive material on said electrical contact regions of said transistor, said uncovered section functioning as a heating resistor;

applying a first passivation layer comprised of silicon nitride onto said resistor;

applying a second passivation layer comprised of silicon carbide onto said first passivation layer;

applying a cavitation layer comprised of a metal selected from the group consisting of tantalum, tungsten, and molybdenum onto said second passivation layer;

applying an ink barrier layer comprised of plastic onto said cavitation layer; and securing a plate member having at least one opening therethrough onto said ink barrier layer, said ink barrier layer having a section thereof removed directly beneath said opening through said plate member in order to form an ink receiving cavity thereunder, said heating resistor being positioned beneath and in alignment with said ink receiving cavity in order to impart heat thereto.

18. A method for manufacturing a thermal inkjet printing apparatus comprising the steps of:

providing a substrate having at least one drive transistor thereon, said drive transistor comprising a plurality of electrical contact regions thereon;

applying a layer of electrically resistive material onto said substrate and onto said electrical contact regions of said transistor, said layer of electrically resistive material comprising at least one metal therein;

applying a layer of conductive material directly onto said layer of electrically resistive material, said layer of electrically resistive material having at least one uncovered section wherein said layer of conductive material is absent therefrom, said layer of conductive material covering said layer of electrically resistive material on said electrical contact regions of said transistor, said uncovered section functioning as a heating resistor, said layer of conductive material comprising at least one metal therein;

applying a portion of protective material onto said resistor;

securing a plate member having at least one opening therethrough onto said portion of protective material, said portion of protective material having a section thereof removed directly beneath said opening through said plate member in order to form an ink receiving cavity thereunder, said heating resistor being positioned beneath and in alignment with said ink receiving cavity in order to impart heat thereto;

providing a housing having storage means therein for retaining a supply of liquid ink, said housing further comprising at least one outlet therethrough; and securing said substrate to said housing at a position thereon so that said ink receiving cavity of said printhead is in fluid communication with said storage means through said outlet.

19. The method of claim 18 wherein said layer of electrically resistive material is comprised of a mixture of tantalum and aluminum.

20. The method of claim 18 wherein said layer of conductive material is comprised of a metal selected from the group consisting of aluminum, copper, and gold.

21. The method of claim 18 wherein said applying of said portion of protective material comprises the steps of:

applying a first passivation layer comprised of silicon nitride onto said resistor;

applying a second passivation layer comprised of silicon carbide onto said first passivation layer;

applying a cavitation layer comprised of a metal selected from the group consisting of tantalum, tungsten, and molybdenum onto said second passivation layer; and applying an ink barrier layer comprised of plastic onto said cavitation layer, said plate member being secured to said ink barrier layer.

22. A method for manufacturing a thermal inkjet printing apparatus comprising the steps of:

providing a substrate having at least one drive transistor thereon, said drive transistor comprising a plurality of electrical contact regions thereon;

applying a layer of electrically resistive material onto said substrate and onto said electrical contact regions of said transistor, said layer of electrically resistive material being comprised of a mixture of tantalum and aluminum;

applying a layer of conductive material comprised of a metal selected from the group consisting of aluminum, copper, and gold directly onto said layer of electrically resistive material, said layer of electrically resistive material having at least one uncovered section wherein said layer of conductive material is absent therefrom, said layer of conductive material covering said layer of electrically resistive material on said electrical contact regions of said transistor, said uncovered section functioning as a heating resistor;

applying a first passivation layer comprised of silicon nitride onto said resistor;

applying a second passivation layer comprised of silicon carbide onto said first passivation layer;

applying a cavitation layer comprised of a metal selected from the group consisting of tantalum, tungsten, and molybdenum onto said second passivation layer;

applying an ink barrier layer comprised of plastic onto said cavitation layer;

securing a plate member having at least one opening therethrough onto said ink barrier layer, said ink barrier layer having a section thereof removed directly beneath said opening through said plate member in order to form an ink receiving cavity thereunder, said heating resistor being positioned beneath and in alignment with said ink receiving cavity in order to impart heat thereto;

providing a housing having storage means therein for retaining a supply of liquid ink, said housing further comprising at least one outlet therethrough; and securing said substrate to said housing at a position thereon so that said ink receiving cavity of said printhead is in fluid communication with said storage means through said outlet.

* * * * *